US010704569B2

(12) United States Patent
Sipola et al.

(10) Patent No.: US 10,704,569 B2
(45) Date of Patent: Jul. 7, 2020

(54) HYDRAULIC SYSTEM AND METHOD FOR CONTROLLING A HYDRAULIC SYSTEM

(71) Applicant: NORRHYDRO OY, Rovaniemi (FI)

(72) Inventors: Ari Sipola, Kangasala (FI); Mika Sahlman, Tampere (FI)

(73) Assignee: NORRHYDRO OY, Rovaniemi (FI)

( * ) Notice: Subject to any disclaimer, the term of this patent is extended or adjusted under 35 U.S.C. 154(b) by 26 days.

(21) Appl. No.: 15/769,351

(22) PCT Filed: Oct. 19, 2015

(86) PCT No.: PCT/FI2015/050706
§ 371 (c)(1),
(2) Date: Apr. 19, 2018

(87) PCT Pub. No.: WO2017/068229
PCT Pub. Date: Apr. 27, 2017

(65) Prior Publication Data
US 2018/0306211 A1 Oct. 25, 2018

(51) Int. Cl.
*F15B 11/00* (2006.01)
*F15B 1/027* (2006.01)
(Continued)

(52) U.S. Cl.
CPC ..... *F15B 11/006* (2013.01); *F15B 1/027* (2013.01); *F15B 11/036* (2013.01);
(Continued)

(58) Field of Classification Search
CPC ..... F15B 1/027; F15B 2211/20569; F15B 2211/40592; F15B 11/0426
See application file for complete search history.

(56) References Cited

U.S. PATENT DOCUMENTS 5,011,180 A 4/1991 Dunwoody
9,021,798 B2 5/2015 Sipola et al.
(Continued)

FOREIGN PATENT DOCUMENTS

CN 1965168 A 5/2007
DE 3836371 A1 5/1990
(Continued)

OTHER PUBLICATIONS

Jul. 15, 2016 International Search Report issued in Patent Application No. PCT/FI2015/050706.
(Continued)

*Primary Examiner* — Thomas E Lazo
(74) *Attorney, Agent, or Firm* — Oliff PLC

(57) ABSTRACT

A hydraulic system and a method comprising a linear actuator 23 for generating discrete sum forces, chambers A-D for generating discrete force components, at least two charging circuits 3,4 configured to maintain predetermined pressure levels of hydraulic fluid, independent control interfaces 9-16 configured to open and close connections of the first and second charging circuits to the chambers, and an electronic control unit 50 for controlling the control interfaces. At least two control interfaces are proportional valves which are used as shut-off valves and are independently switchable to the open and closed positions in a controlled manner. Moreover, non-throttled control and secondary control are implemented in the hydraulic system and the method.

18 Claims, 3 Drawing Sheets

(51) Int. Cl.
*F15B 11/036* (2006.01)
*F15B 11/042* (2006.01)

(52) U.S. Cl.
CPC . *F15B 11/0426* (2013.01); *F15B 2211/20569* (2013.01); *F15B 2211/20592* (2013.01); *F15B 2211/212* (2013.01); *F15B 2211/30575* (2013.01); *F15B 2211/3144* (2013.01); *F15B 2211/327* (2013.01); *F15B 2211/40592* (2013.01); *F15B 2211/7055* (2013.01); *F15B 2211/76* (2013.01)

(56) References Cited

U.S. PATENT DOCUMENTS

| | | | | |
|---|---|---|---|---|
| 2001/0032542 | A1 | 10/2001 | Heikkila | |
| 2003/0041598 | A1 | 3/2003 | Takeuchi et al. | |
| 2005/0194225 | A1 | 9/2005 | Antonovsky | |
| 2007/0120662 | A1 | 5/2007 | Bishop | |
| 2011/0259187 | A1* | 10/2011 | Sipola | F15B 11/036 91/59 |
| 2013/0081704 | A1* | 4/2013 | Opdenbosch | E02F 9/2217 137/14 |

FOREIGN PATENT DOCUMENTS

| | | | | |
|---|---|---|---|---|
| DE | 102004027849 | A1 | 1/2006 | |
| DE | 102005014866 | A1 | 10/2006 | |
| JP | S55-163504 | U | 11/1980 | |
| JP | S57-174541 | A | 10/1982 | |
| JP | S61-044002 | U | 3/1986 | |
| JP | H04-011798 | U | 1/1992 | |
| JP | 2001-289203 | A | 10/2001 | |
| JP | 2002-066799 | A | 3/2002 | |
| JP | 2007-247727 | A | 9/2007 | |
| SU | 1019118 | A | 5/1983 | |
| SU | 1701995 | A1 | 12/1991 | |
| SU | 1740802 | A1 | 6/1992 | |
| WO | 2005/121564 | A1 | 12/2005 | |
| WO | 2010/040890 | A1 | 4/2010 | |
| WO | 2014/081353 | A1 | 5/2014 | |
| WO | WO-2014081353 | A1 * | 5/2014 | B62D 12/00 |

OTHER PUBLICATIONS

Jul. 15, 2016 Written Opinion of the International Searching Authority issued in Patent Application No. PCT/FI2015/050706.
Jun. 9, 2009 Office Action issued in Finland Patent Application No. 20085958.
Jun. 8, 2009 Search Report issued in Finnish Patent Application No. 20085958.
Aug. 24, 2009 International Search Report issued in Patent Application No. PCT/FI2009/050252.
Aug. 24, 2009 Written Opinion of the International Searching Authority issued in Patent Application No. PCT/FI2009/050252.
Feb. 9, 2011 International Preliminary Report on Patentability issued in Patent Application No. PCT/FI2009/050252.
Translation of Dec. 11, 2012 Office Action issued in Russian Patent Application No. 2011118361.
Jun. 7, 2013 Extended European Search Report issued in Patent Application No. 12187900.1.
Jul. 11, 2013 Extended European Search Report issued in Patent Application No. 09818842.8.
Translation of Jul. 31, 2013 Office Action issued in Chinese Patent Application No. 200980149893.3.
Translation of Jul. 7, 2014 Office Action issued in Japanese Patent Application No. 2011-530514.

* cited by examiner

HYDRAULIC SYSTEM AND METHOD FOR CONTROLLING A HYDRAULIC SYSTEM

FIELD OF THE PRESENT SOLUTION

The present solution relates to a hydraulic system. The present solution also relates to a method for controlling a hydraulic system.

BACKGROUND OF THE SOLUTION

In conventional hydraulic systems, the load is controlled by an actuator with one or more working chambers. The pressure of the hydraulic fluid in the system acts on the effective area of the working chamber and generates a force acting on the load via the actuator. The magnitude of the force will depend on both the effective area and the pressure level of the hydraulic fluid. Typical examples of applying the generated force are transferring, lifting and lowering a load. The load is, for example, a part of a structure, an apparatus or a system to be moved, or a piece to be moved by said part.

The control of the pressure level may be based on lossy control, and the control of the magnitude of the force generated by the actuator is performed by stepless control of the pressure level of the working chambers. Thus, the pressure level of the working chamber is adjusted by throttling the flow of hydraulic fluid entering or leaving the working chamber, by means of control valves.

Conventional hydraulic systems have a pressure side in which the pressure is controlled and which only produces a volume flow of hydraulic fluid, as well as a return side which only receives the volume flow and in which the prevailing pressure level is as low as possible, a so-called tank pressure, or a counter pressure needed for controlling the load. The pressure and return sides are equipped with control valves for controlling said pressure level, counter pressure and load.

Problems in conventional systems include losses in hydraulic output of the control valves, caused by throttling of the flow of hydraulic fluid, that is, the throttle control.

Hydraulic systems based on non-throttled control are also known, which utilize actuators with two or more working chambers, two or more pressure levels of hydraulic fluid, and control interfaces which are opened and closed. The control interfaces connect the desired pressure level to each working chamber of the actuator, and each working chamber generates a force component corresponding to said pressure level. The combined force components of the actuator make up the sum force of the actuator. There are many of these sum forces, they are discrete and constitute force steps which may be used to control the load connected to the actuator, and the state of the load, and this is referred to as so-called force control.

An example of such a hydraulic system based on non-throttled control is presented in WO 2010/040890 A1.

In hydraulic systems based on the non-throttled control, the pressure levels of the hydraulic fluid vary in several different working chambers simultaneously, which in some situations of coupling between the force steps may cause unnecessary variation or vibration in the sum force of the actuator.

SUMMARY OF THE SOLUTION

The aim is to present a new solution for a hydraulic system based on non-throttled control and secondary control.

A control valve to be applied in the system according to the solution is preferably a quick proportional valve which has a low pressure loss and which in the presented solution is used as a shut-off valve and which is shifted to an open position and a closed position in a controlled manner. Furthermore, in an example of the solution, the delay of the proportional valve taken for opening and/or closing is controlled, preferably in a stepless manner.

The proportional valve is a control valve in which the volume flow of hydraulic fluid may be controlled in a stepless manner, and in which the cross-sectional area of the flow path, that is, the opening of the proportional valve, may be controlled in a stepless manner, for example from the closed position to the open position, or vice versa. The proportional valve is electrically controlled and is based on a proportional magnet. The proportional valve is controlled by a control signal which is proportional to the opening.

In an example of the solution, the proportional valve is a directional proportional valve, for example a 2-way directional proportional valve. The type of the proportional valve may be a directly controlled or pilot valve.

Further, in an example of the solution, the amount of the opening and/or closing of the proportional valve is controlled; in other words, the opening of the proportional valve is controlled.

The hydraulic system according to the presented solution applies a number of proportional valves which control an actuator that generates discrete sum forces by means of state changes. The sum forces make up force steps to be used for controlling the load. Each proportional valve is controlled individually during the state changes. When two or more proportional valves operate simultaneously for changing a force step in connection with a state change, their operation is synchronized.

The actuator in question is particularly a multi-chamber linear actuator, for example a hydraulic cylinder. The linear actuator is secondary controlled and utilizes force steps and non-throttled control. The linear actuator has several chambers, so-called working chambers, the ratios between their effective areas being selected in a predetermined way, for example according to a binary series.

The present solution provides for significant savings in energy and hydraulic power, compared with conventional hydraulic systems.

In a hydraulic system according to the present solution, the change in the pressure levels of hydraulic fluid in the chambers of the linear actuator is controlled more comprehensively than before. By using the presented solution, the sum forces generated by the linear actuator are controlled more comprehensively than before. By means of the presented solution, the change of one sum force to another sum force in the linear actuator is controlled more comprehensively. By means of the presented solution, state changes of force steps formed by sum forces are controlled more comprehensively. By the presented solution, unnecessary variation or vibration in the sum force can be avoided, and the control of the load is enhanced.

Said variations and vibrations may occur particularly in a situation in which one control valve is opening and another one is closing. The control valves may be either open or closed at the same time, which affects the pressure level of the chamber of the linear actuator. When a proportional valve is used as the control valve, said situation is controlled in a more comprehensive way, for example by controlling the delay or the opening of the proportional valve, and by synchronizing the operation of the proportional valves.

The hydraulic system according to the presented solution is intended for controlling the force, moment, acceleration, angular acceleration, speed, angular speed, position, or rotation generated by the linear actuator driven by hydraulic fluid.

In addition, the hydraulic system may comprise one or more rotary actuator, for example a hydraulic motor, which may be a variable displacement motor. In an example, said hydraulic motor is a secondary controlled variable displacement motor.

Moreover, the hydraulic system may comprise one or more energy storage unit, for example a pressure accumulator.

In the presented solution, the hydraulic fluid is, for example, mineral oil based or synthetic hydraulic fluid, water, or water based hydraulic fluid. However, the type of the hydraulic fluid is not limited but it may vary according to the needs of the application and the requirements set.

In an example of the solution, the hydraulic system is used for recovering energy generated by the linear actuator, for example in charging circuits or pressure accumulators. Energy is recovered, for example, in a situation in which energy is returned to the hydraulic system. In another example, the hydraulic power generated by the linear actuator is recovered and used simultaneously in other actuators of the hydraulic system. Examples of such other actuators include a hydraulic pump, the above mentioned rotary actuator, or a corresponding linear actuator. In another example, energy may also be returned by other rotary actuators of the hydraulic system, for example by a secondary controlled variable displacement motor, to the hydraulic system, for example to charging circuits or pressure accumulators.

The presented solution applies at least two charging circuits, for example a charging circuit of high pressure and a charging circuit of low pressure, which means that the predetermined absolute pressure levels of said charging circuits differ from each other. The pressure level of each charging circuit is selected to be suitable for the application.

In an example of the solution, the hydraulic energy needed and the predetermined pressure levels for the charging circuits are provided by means of one or more charging units. The charging unit may comprise one or more rotary actuator, for example a hydraulic pump, which may be a variable displacement pump.

A conventional hydraulic system which applies a proportional valve and a linear actuator, involves throttle control. In the throttle control, the volume flow of the hydraulic fluid flowing through the proportional valve is controlled in a stepless manner. The pressure level in the linear actuator coupled to the proportional valve depends on the load, and the pressure loss effective over the proportional valve depends on the volume flow.

In the present solution, there is no throttle control, and the proportional valve is not used in the stepless control of the volume flow as in the conventional control of a linear actuator, when implementing e.g. speed control.

In the present solution, non-throttled control is applied by using proportional valves, and secondary control is applied by coupling stable predetermined pressure levels to the chambers of the linear actuator by means of proportional valves, by utilizing charging circuits. In this way, predetermined force steps are produced, for achieving desired acceleration or deceleration of the load.

The applications of the hydraulic system according to the presented solution may vary, but the most typical applications of secondary controlled hydraulic linear actuators include various swivelling, rotating, lifting, lowering and transmission applications which may also involve rotary actuators. The hydraulic system is suitable for objects having inertial masses to be accelerated and decelerated which are relatively significant with respect to the power output of the linear actuator, whereby significant energy savings are achievable.

In this description, secondary control also refers to some examples of the presented solution in which the actuator of the hydraulic system is capable of returning energy to a charging circuit coupled to it, either from another charging circuit or from the outside of the hydraulic system. Returning takes place particularly to a charging circuit of a higher pressure level when the hydraulic system also comprises a charging circuit of a lower pressure level.

BRIEF DESCRIPTION OF THE DRAWINGS

The presented solution will be described in more detail by means of some examples and with reference to the appended drawings.

MORE DETAILED DESCRIPTION OF THE SOLUTION

Figure 1:
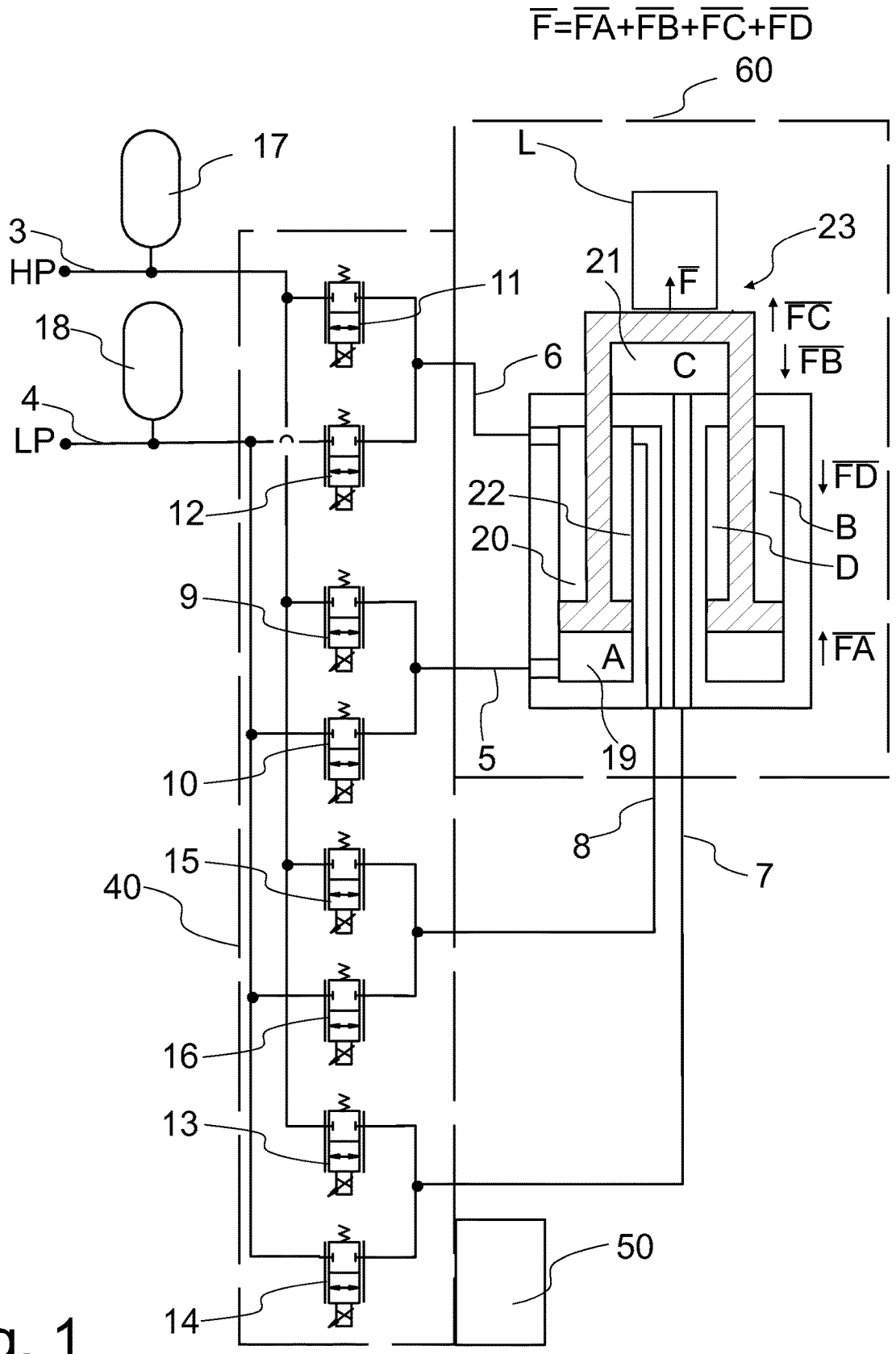
FIG. 1 shows a hydraulic system according to an example of the solution, which utilizes a linear actuator with four chambers.

FIG. 1 shows an example of the hydraulic system according to the solution, which is based on a secondary controlled linear actuator and non-throttled control implemented by proportional valves.

The hydraulic system may comprise at least two charging circuits 3 and 4, at least one actuator 60 which is a multi-chamber linear actuator 23, and a control circuit 40 with several control interfaces 9 to 16 and lines 5 to 8 for hydraulic fluid, as well as an electronic control circuit 50.

The charging circuit 3 is a high pressure charging circuit 3, so-called HP line, and the charging circuit 4 is a low pressure charging circuit 4, so-called LP line.

Each charging circuit 3, 4 comprises hydraulic fluid lines connected to each other and having the same pressure level. Each charging circuit 3, 4 is capable of supplying hydraulic fluid to e.g. the actuator 60 as well as receiving a volume flow from e.g. the actuator 60 and simultaneously maintaining a stable predetermined pressure level. A filter for hydraulic fluid, a pressure relief valve, or other necessary auxiliary components may be connected to the charging circuit 3, 4.

The linear actuator 23 has at least four chambers 19, 20, 21, 22, which are so-called A, B, C and D chambers. The linear actuator 23 comprises a frame and a piston structure linearly movable with respect to the frame and acting on e.g. a load L, for example directly or via a piston rod. The chambers 19 to 22 are so-called displacement chambers whose volume changes as the piston structure moves and which have an effective area subjected to the pressure of the hydraulic fluid. The linear actuator 23 and the sum force F generated by it act on e.g. the load L.

In this description, the term linear actuator also refers to the actuator unit acting on the load L and comprising multi-chamber linear actuators or, alternatively, a combination of one or two chamber linear actuators.

At least two charging circuits 3, 4 are connected to each chamber 19 to 22 of the linear actuator 23; in the example of FIG. 1 the HP line and the LP line.

Figure 2:
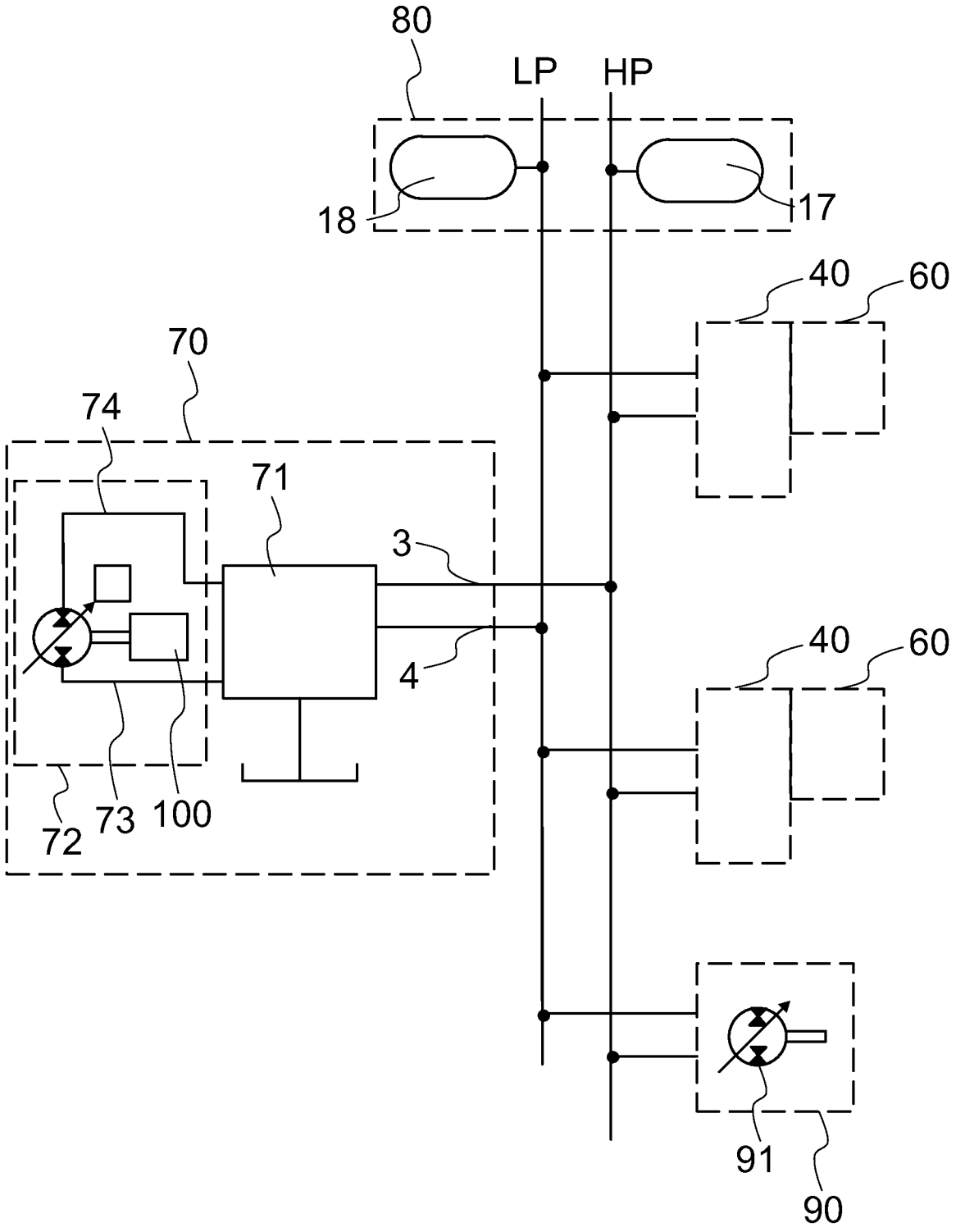
FIG. 2 shows a hydraulic system according to another example of the solution.

A line for hydraulic fluid is connected to each chamber 19 to 22 of the linear actuator 23, and said line is connected to at least two charging circuits 3, 4. Said lines 5 to 8 in combination with the charging circuits 3, 4 enable the flow of hydraulic fluid between the chambers 19 to 22 of the linear actuator 23 and also between the linear actuator 23 and another actuator 60, 90 connected to the system, as shown in the example of FIG. 2. In this way, hydraulic energy may be transferred between different actuators or to the charging circuit 3, 4.

The line 5 is connected to the chamber A of the linear actuator 23, the line 6 is connected to the chamber B, the line 7 is connected to the chamber C, and the line 8 is connected to the chamber D of the actuator 23. In an example, a pressure relief valve or other necessary auxiliary components may be connected to each line 5 to 8.

Each control interface 9 to 16 controls the connection of one chamber 19 to 22 of the linear actuator 23 to one charging circuit 3, 4, for example the connection of chamber A to the HP line or the connection of chamber A to the LP line. The control interfaces 9 to 16 are placed in the lines 5 to 8.

Each control interface 9 to 16 controls the entry of hydraulic fluid into the linear actuator 23 and its returning from the linear actuator 23 independently, that is, separately from the other control interfaces 9 to 16, and individually.

The control interface 9 controls the connection between the HP line and the chamber A; the control interface 10 controls the connection between the LP line and the chamber A; the control interface 11 controls the connection between the HP line and the chamber B; the control interface 12 controls the connection between the LP line and the chamber B; the control interface 13 controls the connection between the HP line and the chamber C; the control interface 14 controls the connection between the LP line and the chamber C; the control interface 15 controls the connection between the HP line and the chamber D; and the control interface 16 controls the connection between the LP line and the chamber D.

In the presented solution, at least two control interfaces 9 to 16 are comprised by a control valve which is a proportional vale of the above presented type, is used as a shut-off valve, and is shifted to the open position and the closed position in a controlled manner. According to an example and FIG. 1, each control interface 9 to 16 or at least eight control interfaces 9 to 16 are comprised by a proportional valve of the above presented type.

According to an example and FIG. 1, said proportional valve is a 2-way directional proportional valve.

Further according to an example, at least two control interfaces 9 to 16 in the hydraulic system according to the present solution may be comprised by a control valve which is a shut-off valve and is shifted in a controlled manner to either the open position or the closed position only. In an example, said shut-off valve is an electrically controlled on-off valve which is preferably quick and has a low pressure loss, for example a 2-way directional valve. Said shut-off valves are also used to implement the above presented non-throttled control and secondary control, if a more comprehensive control of the pressure level of a chamber in the linear actuator and the use of proportional valves are not necessary.

Figure 4:
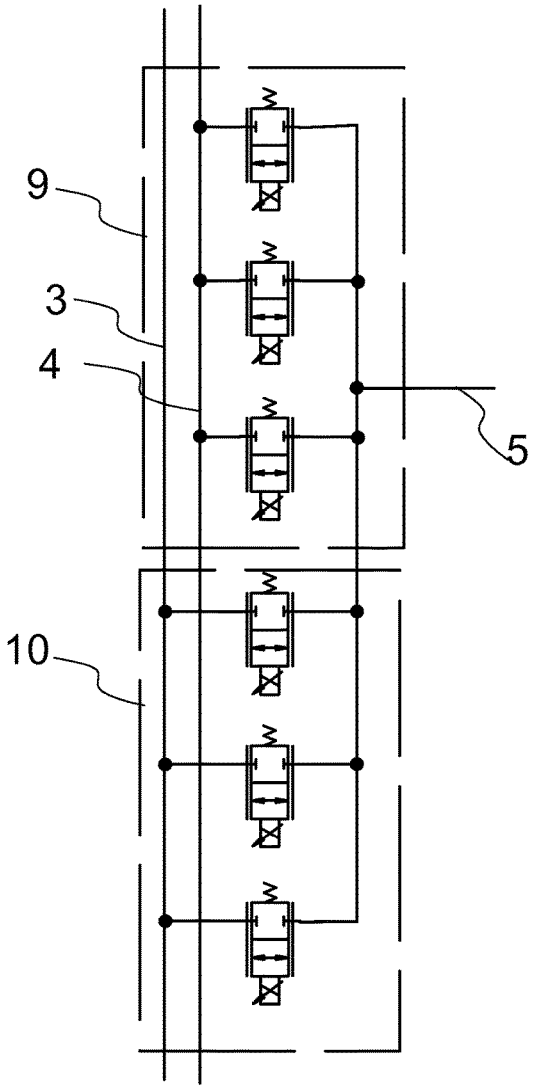
FIG. 4 shows a hydraulic system according to a third example of the solution.

In an example and FIG. 4, at least one control interface 9, 10 alternatively comprises several control valves, for example 2 to 5 valves, coupled in parallel on the same line so that in combination they will define the maximum value of the volume flow of hydraulic fluid in said line 5. The volume flow will depend on the state of each control valve in the control interface 9, 10; in other words, whether the control valve is open or closed. Said control valves are also used to implement the above presented non-throttled control. The control valve is preferably quick and has a low pressure loss. According to the example of FIG. 4, each control valve is a proportional valve of the above presented type. In another example, each control valve is a shut-off valve of the above presented type.

Moreover, the hydraulic system may comprise at least one pressure accumulator 17 connected to the HP line, and at least one pressure accumulator 18 connected to the LP line. The pressure accumulator 17, 18 is used both as an energy storage and a source of hydraulic fluid.

In the example of FIG. 1, the two chambers produce a movement in the same first direction, extending the linear actuator 23, and two working chambers 20, 22 produce a movement in the opposite direction, retracting the linear actuator 23.

In an example and FIG. 1, the linear actuator 23 is also configured, with respect to the effective areas of the chambers 19 to 22, such that the relative values of the effective areas of the chambers 19 to 22 follow weighting coefficients of the binary system, for example "1, 2, 4, 8", so that the linear actuator 23 may also called binary coded (see the series $M^N$, in which M is 2). The sum forces F generated by the binary coded linear actuator 23 are unequal and are uniformly stepped as force steps.

Figure 3:
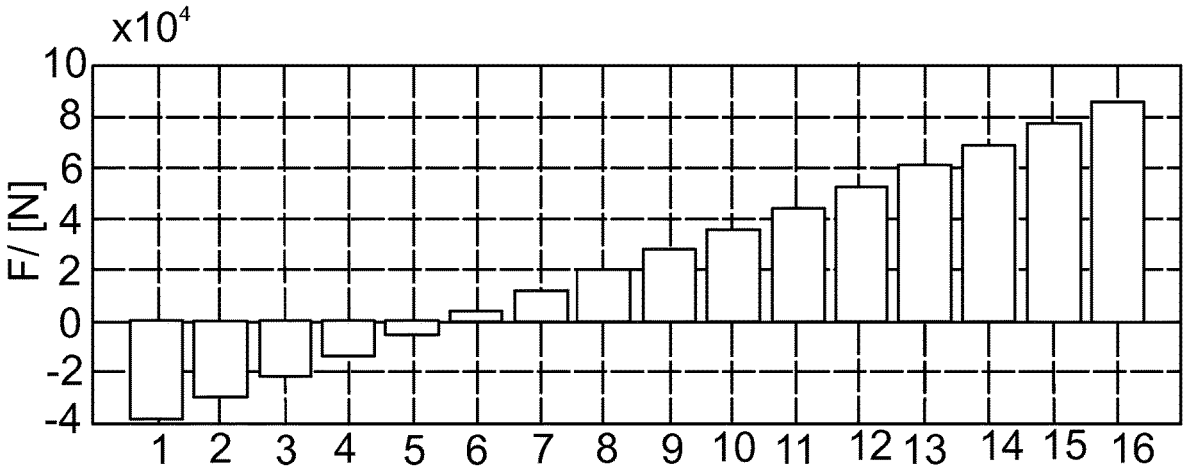
FIG. 3 shows force steps generated by the hydraulic system according to an example of the solution.

An example of sum forces F generated by the linear actuator 23 is shown in FIG. 3 which illustrates force steps 1 to 16 when two charging circuits 3, 4 are used and the linear actuator 23 comprises four chambers 19 to 22, the ratios of their effective areas following said binary coding.

In another example, the ratios of the effective areas of the chambers of the linear actuator 23 follow the series $M^N$, the series "1, 1, 3, 6, 12, 24", the Fibonacci series, or the PNM series.

Each chamber 19 to 22 of the linear actuator 23, connected to at least two charging circuits 3, 4, may generate force components FA, FB, FC, FD which correspond to the pressure levels of said at least two charging circuits 3, 4.

The force components FA, FB, FC, FD produced by the chambers 19 to 22 are illustrated in the example of FIG. 1.

The number of sum forces F generated in the linear actuator 23 is $2^n$, n being the number of chambers 19 to 22 of the linear actuator 23, to which two charging circuits 3, 4 are connected. The linear actuator 23 of the example of FIG. 1 provides 16 different combinations of force components FA to FD generated by the chambers 19 to 22 so that 16 sum forces F may be generated by the linear actuator 23, as shown in FIG. 3.

In another example, the number of sum forces F generated in the linear actuator 23 is $m^n$, n being the number of chambers 19 to 22 of the linear actuator 23, to which m charging circuits 3, 4 are connected.

The force components FA to FD generated by the chambers 19 to 22 of the linear actuator 23 may be effective in the same direction or in the opposite direction. The combined force components FA to FD determine the magnitude and direction of action of each sum force F generated by the linear actuator 23. The generated sum forces F may be effective in the same direction or in opposite directions.

The electronic control unit 50 controls the control interfaces 9 to 16 of the control circuit 40 and the control valves therein, for example by means of electronic control signals. The hydraulic system may comprise various sensors connected to a control unit 50. On the basis of measurement signals from the sensors, the control unit 50 may determine the state of the hydraulic system, the state of the actuators 60, particularly the state of the linear actuator 23, and control the hydraulic system in a predetermined way and to a desired state, for example by means of feedback relating to measurement signals and control. The sensors are, for example, pressure sensors, position sensors, or movement sensors.

The hydraulic system enables and the control unit 50 implements said non-throttled control and secondary control, as well as—in an example—the above described recovery and return of energy to the hydraulic system, by controlling the components and actuators of the hydraulic system. The control unit 50 comprises e.g. a processor that follows desired programmed algorithms. The control unit 50 is configured to implement the predetermined force, moment, acceleration, angular acceleration, speed, angular speed, position, or rotation, relating to the linear actuator 23 or the load L by means of the linear actuator 23.

According to an example of the solution and FIG. 2, the hydraulic system may comprise at least one actuator 90 which is a rotary actuator, for example a hydraulic motor 91 which may be a variable displacement motor. In another example, the hydraulic motor 91 is a variable displacement motor having two directions of flow and rotation. Further, the hydraulic motor 91 may be secondary controlled and connected to the control unit 50. The actuator 90 is coupled to one or more charging circuits 3, 4. With secondary control, the actuator 90 may also return energy to the hydraulic system, as described above. In an example, the operation of the actuator 90 is controlled by a control valve.

According to one example of the solution and FIG. 2, the hydraulic system may comprise one or more energy storage unit 80 which is, for example, a pressure accumulator or a device that utilizes potential energy. An example of the energy storage unit 80 is a pressure accumulator 17, 18. The energy storage unit 80 is connected to the HP line or the LP line. The energy storage unit 80 is capable of converting hydraulic energy of the hydraulic system to potential or kinetic energy, and returning potential or kinetic energy to hydraulic energy to be used by the hydraulic system. The energy storage unit 80 may be used to recover energy generated or returned by the actuator 80, 90 or the linear actuator 23.

The hydraulic system may also comprise one or more charging unit 70 for generating hydraulic energy to one or more charging circuit 3, 4 and maintaining predetermined pressure levels of the charging circuits 3, 4. The charging unit 70 utilizes, for example, kinetic energy and converts it to hydraulic energy. The control unit 50 may control the operation of the charging unit 70.

The operation of the actuator 60, 90, for example the linear actuator 23, may be energy binding (for example lifting of a load L or acceleration) or energy releasing (for example lowering of the load L or deceleration). In an example, the charging unit 70 or an actuator in the charging unit 70 may also transfer energy to the outside of the hydraulic system by utilizing excess energy and hydraulic power of the hydraulic system and by producing kinetic energy or electric energy by means of a motor or a generator.

In an example, the charging unit 70 also transfers energy from one charging unit 3, 4 to another, for example from the HP line to the LP line, or to the outside of the hydraulic system.

In an example and FIG. 2, the charging unit 70 comprises at least one hydraulic pump 72, for example a variable displacement pump. In another example, the hydraulic pump 72 is a variable displacement pump having two directions of flow and rotation. In a third example, said variable displacement pump may also be used as a secondary controlled hydraulic motor, for example for producing kinetic energy.

The hydraulic pump 72 is connected to a motor 100 for producing kinetic energy, which may be an internal combustion engine or an electric motor.

The charging unit 70 may also comprise a coupling unit 71, by which the charging unit 70 is connected to at least one charging circuit 3, 4, for example the HP line, the LP line or both of them, in a controlled manner. The control unit 50 may control the operation of the coupling unit 71. In an example, the coupling unit 71 comprises one or more control valve for controlling the pressure or volume flow of the hydraulic fluid, or for controlling the flow of the hydraulic fluid.

A line 73, 74 of hydraulic fluid may be connected to the hydraulic pump 72. In an example, the function of the coupling unit 71 is to connect lines 73, 74 together or to several charging circuits 3, 4 as desired. The function of the coupling unit 71 may also be to connect the line 73, the line 75 or the charging circuit 3, 4 to the tank of hydraulic fluid as desired.

The present solution is not limited to the above presented figures, alternatives or examples only, but it may be applied within the scope of the appended claims.

The invention claimed is:

1. A hydraulic system comprising:

a linear actuator configured to generate a plurality of discrete sum forces of different magnitudes;

at least four chambers provided in the linear actuator and configured to generate a plurality of discrete force components where combinations of the plurality of discrete force components generate the plurality of sum forces;

at least two charging circuits configured to maintain predetermined pressure levels of hydraulic fluid including a first pressure level of a first charging circuit of the at least two charging circuits and a second pressure level of a second charging circuit of the at least two charging circuits, and the at least two charging circuits being configured to supply hydraulic fluid to the linear actuator and to receive hydraulic fluid from the linear actuator;

a plurality of independent control interfaces configured to open and close connections of the first and second charging circuits to the at least four chambers, the plurality of control interfaces including at least:

a first control interface configured to open and close the connection of the first charging circuit to the first chamber; and a second control interface configured to open and close the connection of the second charging circuit to the first chamber; and an electronic control unit configured to control at least two of the plurality of control interfaces, including the first and the second control interfaces, wherein:

at least two of the control interfaces, including the first and the second control interfaces, are proportional valves which are used as shut-off valves and are independently shiftable to the open and closed positions in a controlled manner, and the control unit, the linear actuator, and the proportional valves are configured to couple the first and second pressure levels to the first chamber causing discrete force components to be produced corresponding the first and second pressure levels.

2. The hydraulic system according to claim 1, wherein, for generating discrete force components and switching sum forces, the control unit is configured:

to shift the first control interface to either the open or the closed position, and to shift the second control interface to either the open or the closed position, and to synchronize the operations of the first control interface and the second control interface.

3. The hydraulic system according to claim 1, wherein at least one of the proportional valves is an electronically controlled 2-way directional proportional valve with an opening controlled in a stepless manner.

4. The hydraulic system according to claim 1, wherein the control unit, the linear actuator, and the proportional valves are configured to implement non-throttled control.

5. The hydraulic system according to claim 1, wherein each sum force is a combination of at least two force components, and the control unit is configured to control the control interfaces so that force components are generated for forming sum forces and for acting on a state of the linear actuator.

6. The hydraulic system according to claim 1, wherein the control unit is configured to control the control interfaces such that hydraulic fluid is received from the linear actuator by one of the charging circuits, and hydraulic fluid is conveyed from another one of the charging circuits to the linear actuator.

7. The hydraulic system according to claim 1, further comprising:

an energy storage unit is connected to one or more charging circuit of the at least two charging circuits configured to convert hydraulic energy to potential or kinetic energy and to return potential or kinetic energy to hydraulic energy; or at least one first pressure accumulator is connected to the first charging circuit, and at least one second pressure accumulator is connected to the second charging circuit.

8. The hydraulic system according to claim 1, further comprising:

at least one charging unit configured to provide hydraulic energy to at least one charging circuit of the at least two charging circuits, or the at least one charging unit is configured to transfer hydraulic energy between two or more charging circuits of the at least two charging circuits or to transfer hydraulic energy out of the hydraulic system in the form of kinetic energy or electric energy.

9. The hydraulic system according to claim 8, wherein at least two control interfaces of the plurality of control interfaces are on-off valves which are used as shut-off valves and are independently shiftable to the open and closed positions in a controlled manner.

10. The hydraulic system according to claim 1, wherein ratios of effective areas of the at least four chambers of the linear actuator follow a series $N^M$, in which N is a number of the charging circuits and M is an integer.

11. A method comprising controlling a hydraulic system, the hydraulic system including:

a linear actuator for generating a plurality of discrete sum forces of different magnitudes;

at least four chambers provided in the linear actuator and generating a plurality of discrete force components where combinations of the plurality of discrete force components generate the plurality of sum forces;

at least two charging circuits maintaining predetermined pressure levels of hydraulic fluid, the predetermined pressure levels of hydraulic fluid including a first pressure level of a first charging circuit of the at least two charging circuits and a second pressure level of a second charging circuit of the at least two charging circuits, the at least two charging circuits supplying hydraulic fluid to the linear actuator and receiving hydraulic fluid from the linear actuator;

a plurality of independent control interfaces opening and closing connections of the first and second charging circuits to the at least four chambers, the plurality of control interfaces including at least:

a first control interface for opening and closing the connection of the first charging circuit to a first chamber of the at least four chambers, and a second control interface for opening and closing the connection of the second charging circuit to the first chamber; and an electronic control unit controlling at least two of the plurality of control interfaces including the first and the second control interfaces, wherein:

the at least two of the plurality of control interfaces including the first and the second control interfaces, are proportional valves which are used as shut-off valves and are independently shiftable to the open and closed positions in a controlled manner, and the control unit, the linear actuator, and the proportional valves are configured to couple the first and second pressure levels to the first chamber causing discrete force components to be produced corresponding the first and second pressure levels.

12. The method according to claim 11, in which method, for generating discrete force components and switching sum forces, the control unit further:

shifts the first control interface to either the open or the closed position, and shifts the second control interface to either the open or the closed position, and synchronizes the operation of the first control interface and the second control operation.

13. The method according to claim 11, in which method the operation of the first control interface and the second control interface is synchronized by controlling delays of the first control interface and the second control interface.

14. The method according to claim 11, in which method each sum force is a combination of at least two force components, and the control unit controls the control interfaces such that force components are generated for forming sum forces and for acting on a state of the linear actuator.

15. The method according to claim 14, in which method at least one of the proportional valves is an electrically controlled 2-way directional proportional valve with an opening that is controlled in a stepless manner.

16. The method according to claim 11, in which method at least one of the proportional valves is an electrically controlled 2-way directional proportional valve with an opening that is controlled in a stepless manner.

17. The method according to claim 11, wherein the hydraulic system further includes:

an energy storage unit connected to one or more charging circuit of the at least two charging circuits for converting hydraulic energy to potential or kinetic energy and for returning potential or kinetic energy to hydraulic energy; or at least one first pressure accumulator connected to the first charging circuit, and at least one second pressure accumulator is connected to the second charging circuit.

18. The method according to claim 11, wherein:

the hydraulic system further includes at least one charging unit for supplying hydraulic energy to at least one charging circuit of the at least two charging circuits, or the charging unit transfers hydraulic energy between two or more charging circuits of the at least two charging circuits or out of the hydraulic system in a form of kinetic energy or electric energy.

* * * * *